US007165599B2

(12) United States Patent
Takizawa et al.

(10) Patent No.: US 7,165,599 B2
(45) Date of Patent: Jan. 23, 2007

(54) MELTING AND FEEDING METHOD AND APPARATUS OF METALLIC MATERIAL IN METAL MOLDING MACHINE

(75) Inventors: Kiyoto Takizawa, Nagano-ken (JP); Toshiyasu Koda, Nagano-ken (JP); Mamoru Miyagawa, Nagano-ken (JP); Kazuo Anzai, Nagano-ken (JP); Koji Takei, Nagano-ken (JP); Ko Yamazaki, Nagano-ken (JP)

(73) Assignee: Nissei Plastic Industrial Co., Ltd., Nagano-ken (JP)

( * ) Notice: Subject to any disclaimer, the term of this patent is extended or adjusted under 35 U.S.C. 154(b) by 0 days.

(21) Appl. No.: 10/769,092

(22) Filed: Jan. 30, 2004

(65) Prior Publication Data

US 2004/0182537 A1 Sep. 23, 2004

(30) Foreign Application Priority Data

Jan. 31, 2003 (JP) ..... 2003-024773

(51) Int. Cl.
*B22D 17/04* (2006.01)

(52) U.S. Cl. ..... 164/312; 164/316

(58) Field of Classification Search ..... 164/113, 164/312, 316, 900

See application file for complete search history.

(56) References Cited

U.S. PATENT DOCUMENTS

| | | | | |
|---|---|---|---|---|
| 4,225,745 | A * | 9/1980 | Harwell | 373/79 |
| 4,872,907 | A * | 10/1989 | Areaux | 75/375 |
| 5,501,266 | A | 3/1996 | Wang et al. | 164/113 |
| 5,983,976 | A * | 11/1999 | Kono | 164/113 |
| 6,675,867 | B1 * | 1/2004 | Koda et al. | 164/312 |
| 2001/0004930 | A1 | 6/2001 | Takizawa et al. | 164/312 |

* cited by examiner

*Primary Examiner*—Kevin Kerns
*Assistant Examiner*—I.-H. Lin
(74) *Attorney, Agent, or Firm*—Weingarten, Schurgin, Gagnebin & Lebovici LLP

(57) ABSTRACT

In a metal molding machine provided having a tilt to a clamping device with an injection unit which is constituted by a liquid metallic material reservoir in which a cylinder having a nozzle portion at the tip portion equipped with a heating device at the outer periphery and an injection plunger having advance or retreat freely in the inside, and the injection cylinder at the rear portion, the metallic material feeding to the above liquid metallic material reservoir is performed in liquid by melt to the temperature of above the liquidus temperature in a melting cylinder standing the liquid metallic material reservoir to liquid metallic material surface from a feeding pipe having a smaller diameter than the inner diameter of the cylinder. The melting and feeding of metallic material is performed at an atmosphere of an inert gas such as argon.

4 Claims, 3 Drawing Sheets

MELTING AND FEEDING METHOD AND APPARATUS OF METALLIC MATERIAL IN METAL MOLDING MACHINE

This application claims priority to a Japanese application No. 2003-024773 filed Jan. 31, 2003.

FIELD OF THE INVENTION

The present invention relates to a melting and feeding method and a melting feeding apparatus of a metallic material in a metal molding machine which performs to produce a metal product by injecting non-ferrous metal such as zinc, magnesium or an alloy consisting thereof under molten condition into a mold.

BACKGROUND OF THE INVENTION

In the conventional injection molding, the method is to inject a chip type metallic material in completely melting state into a mold by way of feeding from a hopper attached to the melting cylinder which is constituted standing having a tilt on the cylinder having a nozzle member at the tip portion with a heating means at an outer periphery, and an injection plunger in the inside so as to advance or retreat freely (Reference Patent 1: US 2001/0004930A1 Specification and FIG. 1 and FIG. 6).

Moreover, another method is to inject a metallic material as a semi-solid state which is prepared from a liquid metal, by a vertically equipped device wherein it is constituted by a barrel having a nozzle member at the tip portion, an axial cavity in the center and a temperature controller in the outer periphery in order to keep the lower temperature than the liquidus temperature of metal and provided in the inside of the axial cavity a screw for injection so as to rotate or slide freely, then a melting solid metallic material, such as ingot, in a hopper and feeding the liquid metal to the barrel (Reference Patent 2: U.S. Pat. No. 5,501,266 Specification and FIG. 1 and FIG. 3).

The metal molding machine in the reference patent 1 is conducted that a chip type metallic material is introduced to drop directly from a feeding opening on a liquid metal surface through a melting cylinder provided in an injection plunger. A metallic material such as zinc, magnesium or an alloy, which has such an extremely light weight, does not sink in a liquid metal immediately by own weight, however, it may become an accumulated state on the liquid metal even by equipping with an agitating means.

As getting higher, the upper portion of a chip type metallic material on a liquid metal suffers less heating from liquid metal, and melting by agitation is difficult of accomplishment to promote melting, since as in a solid state it is exposed to comparatively a longer period of time in an atmosphere of an inert gas, such as argon, the chip type material becomes just as a baked state to form easily a sludge.

A direct feeding of a chip type metallic material causes a material bridge at a falling gate of a feed opening, thereby a material feeding is difficult to accomplish a smooth falling or the material turns to solidify by an accumulation on an inner surface of a melting cylinder which is located having a tilt under the feed opening so that the accumulation becomes gradually bloated for a long run of operation which encounters a material melting obstacle or an operation obstacle of the plunger. A problem creates a need that the obstacle during operation causes a deteriorated function of the metal molding machine and has a profound effect on the quality of metallic product which is manufactured by the continuous injection molding.

As the method described in the reference patent 2, a metallic material is fed to a vertically stand barrel having an axial cavity in the center and a screw in the inside of the axial cavity as a liquid metal which is melted from a solid state material by a hopper, wherein a semi solid material, which is formed from the liquid metal by shearing/cooling while keeping a barrel below the liquidus temperature, is injected into a mold.

Moreover, since the feeding of a liquid metal is conducted until a filling of a space between the screw flights and the inside walls of the axial cavity, the difficult problem is remained unsolved by such a mold machine in which the injection is performed for a feeding method from a melting cylinder provided having a tilt under the liquid metal state.

SUMMARY OF THE INVENTION

An object of this invention is to provide the new melting and feeding method and apparatus of a metallic material that the described-above problems case, where feeding a chip type metallic material into an injection unit equipped having a tilt, then injecting in liquid by melt, can be solved by feeding by melt in liquid from a melting cylinder standing on a melting metallic material reservoir.

The object of the present invention on the melting and feeding method of a metallic material relates to a method to feed a metallic material by melt to a metal molding machine, wherein the metal molding machine comprises a clamping device, and an injection unit which has a liquid metallic material reservoir with a cylinder which is equipped with a nozzle member at the tip portion, a heating means at an outer periphery, and an injection plunger in the inside thereof so as to advance or retreat freely, respectively, and an injection cylinder provided in the rear portion of the liquid metallic material reservoir and the injection unit is provided having a tilt toward the clamping device; and the feed of the metallic material to said liquid metallic material reservoir is proceeded by feeding the liquid metallic material which is melted after heating above the liquidus temperature of the metallic material by a melting cylinder standing on the liquid metallic material reservoir, and through a feeding pipe which has a smaller inner diameter to the melting cylinder to feed on the liquid metallic material surface in the liquid metallic material reservoir.

The melting and feeding of the metallic material of the method of the present invention is carried out in an inert gas atmosphere.

The present invention relates to an apparatus for feeding a chip type metallic material by melt to a metal molding machine, wherein the metal molding machine comprises a clamping device and an injection unit which has a liquid metallic material reservoir with a cylinder which is equipped with a nozzle member at the tip portion, a heating means at an outer periphery, and an injection plunger in the inside thereof so as to advance or retreat freely, respectively, and an injection cylinder provided in the rear portion of the liquid metallic material reservoir and the injection unit is provided having a tilt toward the clamping device;

said apparatus has a melting cylinder which comprises a feeding pipe having a smaller size diameter from the inner diameter of the melting cylinder at the lower portion of the melting cylinder in order to feed the molten metallic material into the liquid metallic material reservoir, together with a heating means at an outer periphery of the melting cylinder, and a hopper, of which inside provided with a feed screw, connected to the top edge of the melting cylinder; and the apparatus stands on the liquid metallic material reservoir facing the feeding pipe downward.

The present invention relates to an apparatus for feeding a solid form metallic material by melt to the metal molding machine, wherein the metal molding machine comprises a clamping device and an injection unit which has a liquid metallic material reservoir with a cylinder which is equipped with a nozzle member at the tip portion, a heating means at an outer periphery, and an injection plunger in the inside thereof so as to advance or retreat freely, respectively, and an injection cylinder provided in the rear portion of the liquid metallic material reservoir and the injection unit is provided having a tilt toward the clamping device;

said apparatus has a melting cylinder which comprises a feeding pipe having a smaller size diameter from the inner diameter of the melting cylinder at the lower portion of the melting cylinder in order to feed the molten metallic material into the liquid metallic material reservoir, together with a heating means at an outer periphery of the melting cylinder, and a feeding cylinder with a feeding gate, connected to the top end of the melting cylinder; and the apparatus stands on the liquid metallic material reservoir facing the feeding pipe downward.

Moreover, the above mentioned apparatus of the invention has a thrust cylinder at the tip portion of the feeding cylinder wherein plunger of the thrust cylinder is inserted into the feeding cylinder.

Furthermore, the above mentioned apparatus of the invention has a feeding pipe for an inert gas to a space between the bottom of the melting cylinder and the upper surface of the liquid metal in the liquid metal reservoir or the upper space on the melting cylinder.

DETAILED DESCRIPTION OF THE PREFERRED EMBODIMENT

Figure 1:
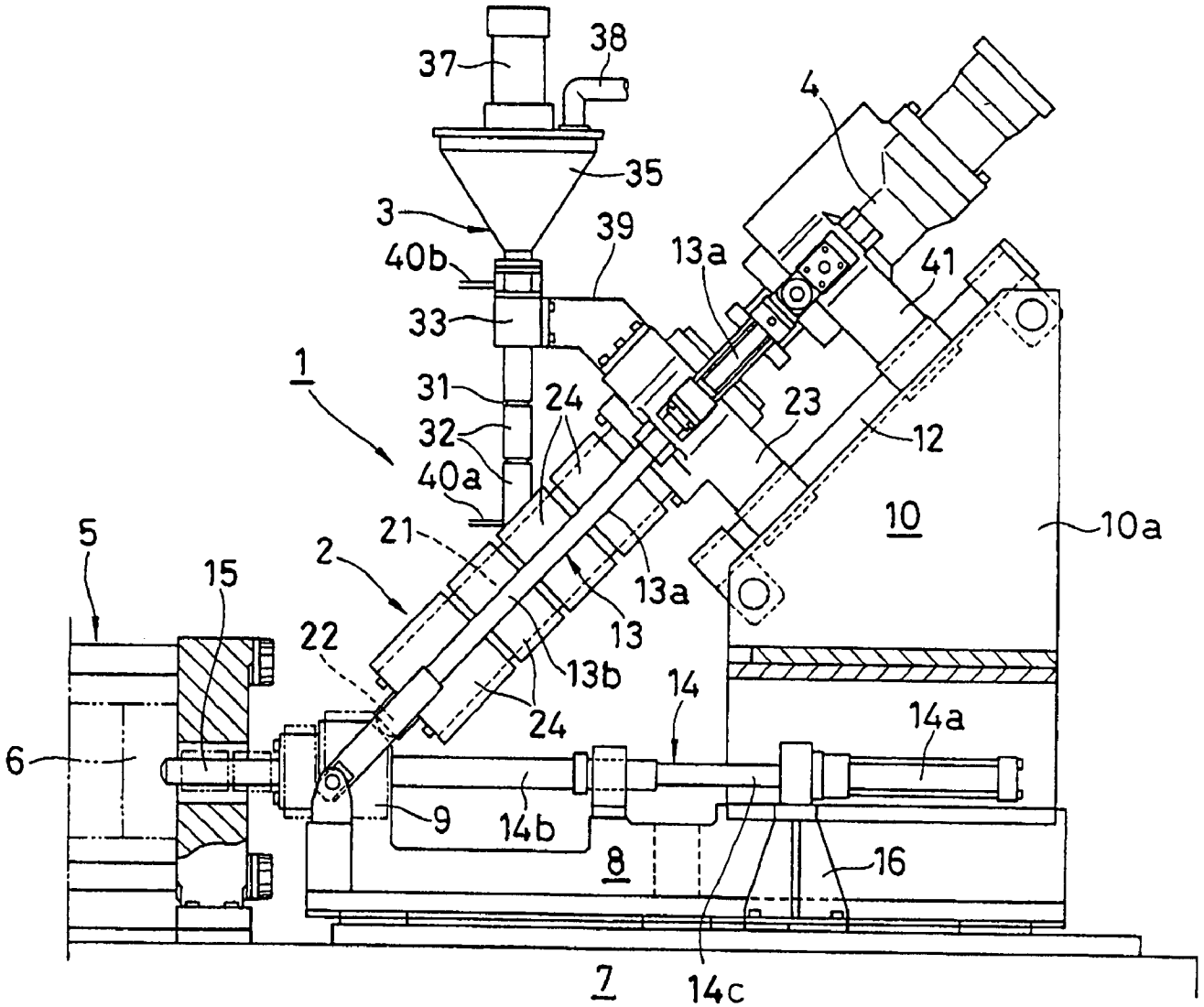
FIG. 1 shows a side view of the metal molding machine provided with the melting and feeding apparatus for the metallic material of the invention.

FIG. 1 is schematically illustrated an injection unit, wherein a liquid metallic material reservoir 2 which has a nozzle member 22 at the tip portion of a cylinder 21, and a melting and feeding apparatus 3 for a metallic material and an injection cylinder 4. A reference numeral 5 is a clamping device of a mold 6 which is provided on the surface of an apparatus pedestal 7 with an injection unit 1.

A reference numeral 8 is a pedestal of the injection unit 1 having, at the front end portion, a nozzle touch block 9 provided a hot runner in the inside and at the rear portion, a pedestal 10 constituted by a plate 10*a* wherein a pair in two sides having approximately 45° angle sloping toward the inward at the upper portion so as to swivel universally, the injection unit is provided having a tilt dawn ward to a clamping device by inserting a supporting leg 23 of the liquid metallic material reservoir and a supporting leg 41 of injection cylinder 4 through a supporting shaft 12 on the pedestal 10 and a nozzle member 22 at the tip portion is nozzle-touched to the upper corner portion of the nozzle touch block 9.

The nozzle-touch device 13 of a liquid metallic material reservoir 2 is constituted by a hydraulic cylinder 13*a* of the side portion provided from a cylinder bearing member 23 of a liquid metallic material reservoir 2 through a supporting leg 41 of an injection cylinder 4, and a rod 13*b* of which the tip portion of a shaft is attached to the bearing on the side of a nozzle touch block 9 so as to swivel universally.

A nozzle touch device 14 of an injection cylinder 15 provided horizontally to the face of the above nozzle-touch block 9 is constituted by a hydraulic cylinder 14*a* fixed to a supporting member 16 which is provided on a surface of a base, a piston rod 14*c* and a rod 14*b* of which tip portion is connected to the rear portion of the nozzle touch block 9. Moreover, the rear portion of the rod 14*b* is connected with the piston rod 14*c* of the hydraulic cylinder 14*a* wherein the pedestal 8 is moved in the advancing or retreating direction together with the rod 14*b*. The liquid metallic material reservoir 2 and the nozzle-touch block 9 on the pedestal 8 are moved in the advancing or retreating direction, accordingly. As a result the injection cylinder 15 provided to the front face of the nozzle-touch block 9 performs to nozzle-touch and release to a mold 6.

Figure 2:
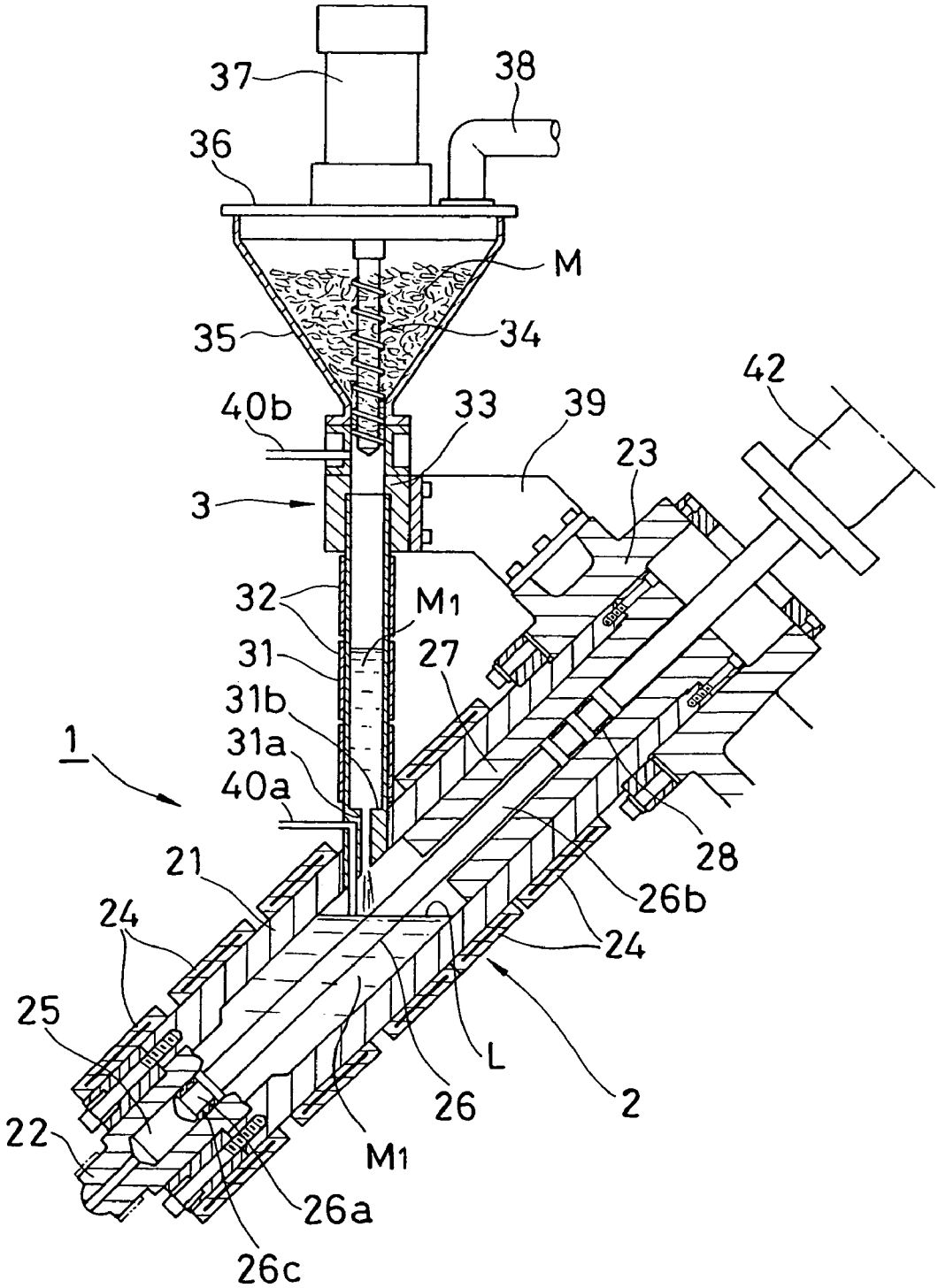
FIG. 2 shows a longitudinal cross-section of the liquid metallic material reservoir and the melting and feeding apparatus for the chip type metallic material of the invention.

The described-above liquid metallic material reservoir 2 comprises a melting and feeding apparatus 3 on a material feeding gate provided in the middle of the upper portion of a cylinder 21 in which is equipped a band heater 24 at the outer periphery so as to preserve the inside temperature of the liquid metallic material to at least above the liquidus temperature. Also as shown in FIG. 2, the tip portion communicated with a nozzle gate of the nozzle member 22 is formed in a metering chamber 25 which has a required length having about from 8 to 15% smaller size than the inner diameter of the cylinder and an injection head 26*a* of an injection plunger 26 is inserted into a metering chamber 25 so as to advance or retreat freely.

Moreover the upper portion of the inside cylinder 21 from the tip portion of a material feeding gate, becomes non-space by blockage of a blockage member 27 provided in the inside of the cylinder. The blockage member 27 is constituted by s shaft having the length from the near of the upper portion of a feeding gate to the back edge of cylinder assembled to the back portion of a cylinder air tightly by bolting where, in the through hole perforated at the center of the blockage member 27, the rear portion of rod 26*b* of a plunger 26 is connected to a piston rod 42 of the injection cylinder 4 and inserted by multiple rings 28 to be airtight so as to advance or retreat freely, where the lower end portion of the blockage member 27 approaches to the top edge portion of a feeding gate.

The thickness size of a rod 26*b* of an injection plunger 26 is different depending upon the inner diameter of a cylinder 21 of a liquid metallic material reservoir 2, however, the ratio between the inner diameter of the cylinder and the rod diameter is above 2.5 and preferable to establish the one side of space between the cylinder inner diameter and the rod outer diameter to above 35 mm. For example, according to the above ratio, in case that the inner diameter of a melting cylinder is 115 mm of size, then the rod diameter becomes in the range from 32 to 40 mm.

Moreover, an injection head 26*a* of an injection plunger 26, where it is equipped with a check valve 26*c* which is buried with a seal ring in the outer periphery so as to advance or retreat freely in which the space formed between an injection head 26*a* and the check valve 26*c* is made open and shut by contact/non-contact with the rear portion face of the check valve 26*c* and a valve seat of the rear portion of the injection plunger, is fit to insert so as to advance or retreat freely to the above metering chamber 25.

In such an injection unit 1, a liquid metallic material (liquid material) in a cylinder 21 is metered by suction in which the injection head 26*a* in the metering chamber 25 is slide-transferred to the rear limit position shown in FIG. 2 by a reverse transfer of an injection plunger 26, then after metering, the metered liquid metallic material is injected to a clamped mold 6 from a nozzle member 22 through a nozzle touch block 9 and an injection cylinder 15 by advance transfer of an injection plunger 26.

The above melting and feeding apparatus 3 is constituted by a melting cylinder wherein a feed pipe 31*a* of having a smaller diameter (e.g. approximately 7 mm) than the inner diameter of a cylinder which circulates a liquid metallic material by blocking out the one end of a long and thin cylinder (e.g. diameter approximately 40 mm, length approximately 500 mm) is perforated, and provided a heating means 32 by a band heater or an induction heater in the outer periphery which is divided into multiple zones for a temperature controllable, and a hopper provided to the inside of a feed screw connected through the medium member 33 with the other portion of the melting cylinder 31. A feed screw 34 is provided by connecting an electric driven motor shaft assembled to a hopper cover board 36 to the inner of the medium member 33 which is the extension of the melting cylinder 31. Further, 38 is a material carrier pipe and 39 is an arm member by which the melting and feeding apparatus 3 is provided securely with a supporting leg 23 of a liquid metallic material reservoir 2.

The melting and feeding apparatus 3 stands on a liquid metallic material reservoir 2 which is inserted to a material feeding gate equipped on said cylinder 21 with a feeding pipe 31*a* of a melting cylinder 31 as the lower portion and a feeding pipe 40*a* and 40*b* for an inert gas such as argon is provided from the lower portion to the inside of a liquid metallic material surface L of a liquid metallic material reservoir 2, together with the upper portion space of the melting cylinder 31.

In such a melting and feeding apparatus 3, a required amount of a chip type metallic material M which is stored in a hopper 35 can be delivered to a melting cylinder 31 by the revolution of a feed screw 34. The melting cylinder 31 and the insides of a hopper 35 and a liquid metallic material reservoir 2 are kept in an inert argon gas atmosphere from a feeding pipe 40*a* and 40*b* connected to the upper and lower portions of the melting cylinder 31.

In case that a chip type material is a magnesium alloy, a melting cylinder 31 is heated to the temperature above the liquidus temperature(from 600° C. to 700° C.), then the chip type material M is delivered to the inside and fallen to the lower portion of the inside cylinder by its own weight. But because of the inner base face 31*b* formed by the formation of the small size feeding pipe 31*a*, the chip type material is melted to liquid by heating from the outer periphery by keeping storage in the cylinder without falling to the inside of a liquid metallic material reservoir 2. The liquid metallic material formed the inside of the melting cylinder 31, without change, flows into a cylinder 21 from a feeding pipe 31*a* by the self-weight, and is stored in the liquid metallic material reservoir 2 as liquid metallic material M1.

In case of feeding a chip type material to a melting cylinder 31, a material bulk in the melting cylinder is controlled to a certain level in constant, by controlling the revolution speed of the feed screw 34 in accordance with a melting capacity. The first feeding amount is set to be multiple batches weight of which is a slightly larger than one batch injection weight, and from the next following run, the required mount of the chip type material is melted by delivering to the melting cylinder 31 from a hopper 35 by a feed screw 34, then flows out to the liquid metallic material reservoir 2 whenever every liquid metallic material face L being lowered, wherein the liquid metallic material face is detected by a detector (Figure omitted) in order to keep the setting level of liquid metallic material face L.

As for a material melting in a melting cylinder 31 which is controlled to the smaller size diameter than a liquid metallic material reservoir 2, the melting efficiency improves for the reason that the heat from a melting cylinder 31 to every chip type material is easily performed by the dense state of the chip type material.

While it is necessary to heat the temperature as high as 650° C. by an enlargement of a melting cylinder volume (liquid metallic material) as in the case of a chip type material melting by a melting cylinder provided the inside of an injection plunger described in the Reference Patent 1, a melting in the liquid metallic material reservoir 2 is unnecessary as in advance by performing melting to the liquid state in the melting cylinder 31.

As a result a stable process molding is possible to proceed than ever before wherein the saving energy is effective by making the smaller volume of cylinder, managing the holding temperature to about 600° C., and becoming a temperature variation of the liquid metallic material small.

Moreover, in a melting cylinder 31, a chip type material melts rapidly by getting heat from the outer periphery while simultaneously dense in state so that no baking state is generated during melting of an accumulation on a liquid metallic material surface, and the formation of a sludge caused by the accumulation is controlled and a sludge deposition acquires a great depression in a liquid metallic material reservoir 2.

A disappearance of a material bridge at a falling gate resulting in case of direct feeding of a chip type material to a melting cylinder or of material accumulation of an inside wall face in melting cylinder located having a tilt in the lower portion of a feeding gate as in the Reference Patent 1 results for making a long period of maintenance of the liquid metallic material reservoir 2 which requires a long working period by decomposition and maintenance only for a melting cylinder, thereby the efficiency of an operation rate becomes elevated in the molding machine.

Figure 3:
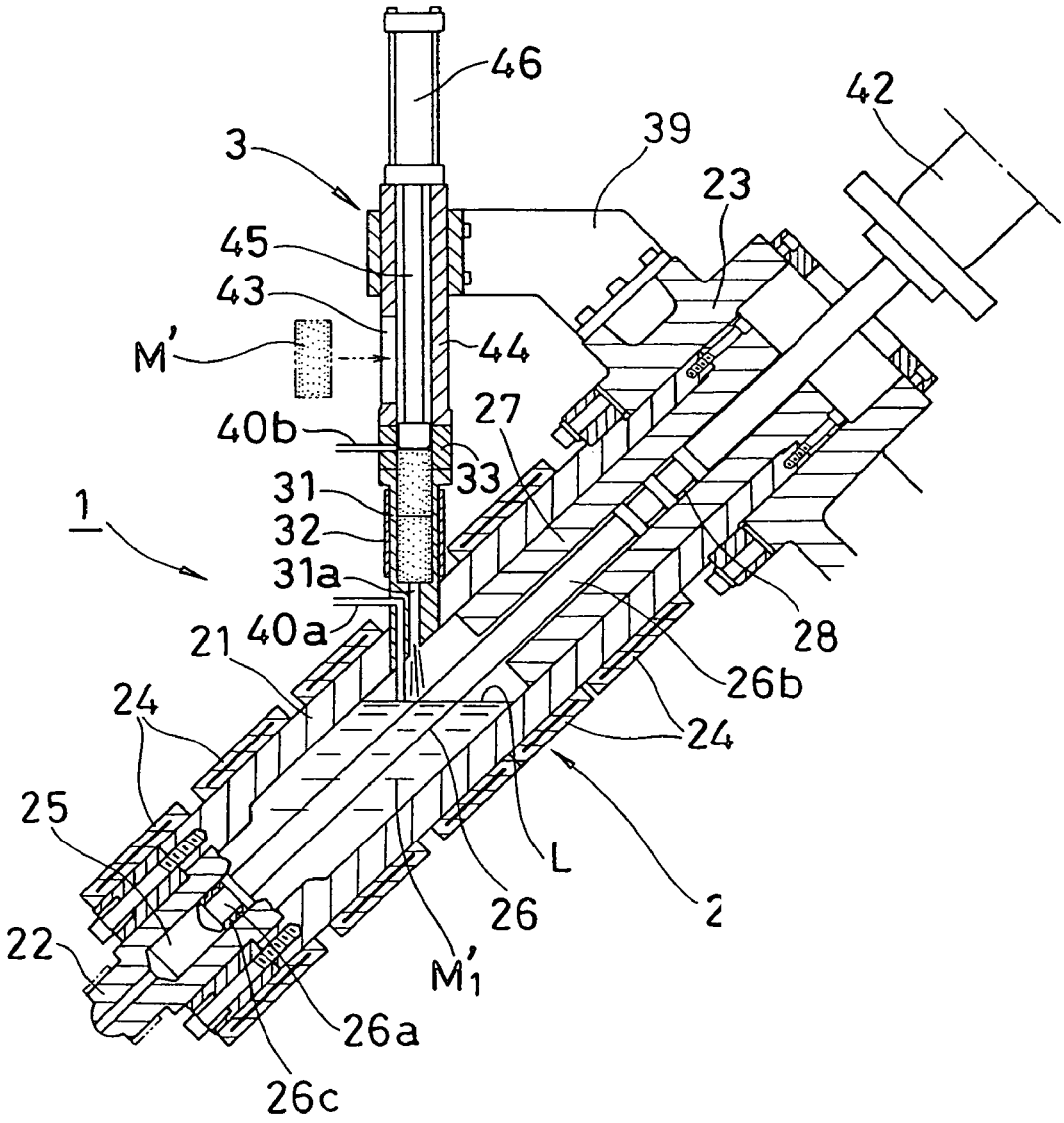
FIG. 3 shows a longitudinal cross-section of the liquid metallic material reservoir and the melting and feeding apparatus for the solid form metallic material of the invention.

FIG. 3 shows a melting and feeding apparatus 3 for a solid form metallic material M', such as short column shape, which is constituted by a feeding cylinder 44 set to the side portion of a feeding gate 43 connected lengthways with an intermediate member 33 at the top portion of the above melting cylinder 31, and air or hydraulic thrust cylinder 46 provided the force to push plunger 45 at the top portion of the feeding cylinder 44 is inserted toward downward direction in the feeding cylinder 44 by the plunger 45, and a feeding pipe 31*a* side of a melting cylinder 31 as a bottom of a melting cylinder 31, to stand on a liquid metallic material reservoir 2 by inserting the melting cylinder 31 into the material feeding gate set in the cylinder 21, where an inert gas feeding cylinder 40*a*, 40*b* are provided from the bottom of the melting cylinder to the inside of the liquid metallic material surface L of the liquid metallic material reservoir 2 and to a space in the top of the melting cylinder 31.

The melting cylinder 31 has an inner diameter appropriate for creating a gap of 2.0 mm or less, more preferably from 0.8 to 1.0 mm, between outer surface of the solid metallic material M' and inner surface of the melting cylinder. The gap constitutes an insulation space for reducing heat conduction from the outside. The gap of more than 2.0 mm is not preferable, because melting speed becomes excessively slow and it takes a long time for melting. For example, when solid metallic material has a short column shape having a diameter of 60 mm, a height of 300 mm and a weight of 1,500 g, an inner diameter of 61 mm is appropriate to the melting cylinder 31.

For such a melting and feeding apparatus 3, a solid material, having the multiple batches amount of weight which is delivered to the feeding cylinder through the feeding gate 43 by a reduction of plunger 45, is forced to push to the inside of melting cylinder 31 by an extension of plunger 45, and thereby is possible to melt to a liquid state by a heating means 32 at the outer periphery. A liquid metal M'1 formed in the melting cylinder 31 is accumulated as the liquid metallic material M'1 in the metallic material reservoir 2 by flowing out to the cylinder 21 from the feeding pipe 31*a* having a small diameter(e.g. 10 mm) by own weight without change. As for a solid form material, such as short column shape, the surface area per weight can be made smaller than a chip material so that the oxide adhered to the material surface is difficult to deliver into a melting cylinder 31 and to a liquid metallic material reservoir 2 and furthermore, a sludge formation by oxidation is inhibited, thereby, an efficiency of operation rate of the molding machine improves as in the case of the chip type material.

What is claimed is:

1. An apparatus for feeding a short column shape solid form metallic material by melt to the metal molding machine, wherein:

the metal molding machine comprises a clamping device and an injection unit, the injection unit comprising a liquid metallic material reservoir comprising a cylinder, a nozzle member at a tip portion of the cylinder, a material feeding gate at an upper portion of the cylinder, a metering chamber at the tip portion of the cylinder, a heating means at an outer periphery, and an injection plunger in the inside of the cylinder having an injection head insertable into the metering chamber so as to advance or retreat freely, respectively, and an injection cylinder provided in the rear portion of the liquid metallic material reservoir, and the injection unit is provided having a tilt toward the clamping device;

said apparatus comprising a melting cylinder configured to conform to and melt the short column shape solid form metallic material, said melting cylinder including a feeding pipe having a smaller size diameter than inner diameter of the melting cylinder at a lower portion of the melting cylinder disposed to feed the molten metallic material into the liquid metallic material reservoir, a heating means at an outer periphery of the melting cylinder, and a feeding cylinder including a feeding gate, connected lengthways in axial alignment with a top end of the melting cylinder and configured to conform to and feed the short column shape solid form metallic material; and the apparatus stands on the liquid metallic material reservoir with the feeding pipe facing downward.

2. The apparatus of claim 1, wherein said feeding cylinder further includes a thrust cylinder at the top portion of the feeding cylinder and a plunger of the thrust cylinder is inserted into the feeding cylinder.

3. The apparatus according to claim 2, further comprising a feeding pipe for feeding an inert gas to a space between the lower portion of the melting cylinder and an upper surface of liquid metallic material in the liquid metallic material reservoir and for feeding an inert gas to an upper space on the melting cylinder.

4. The apparatus according to claim 1, further comprising a feeding pipe for feeding an inert gas to a space between the lower portion of the melting cylinder and an upper surface of liquid metallic material in the liquid metallic material reservoir and for feeding an inert gas to an upper space on the melting cylinder.

* * * * *

UNITED STATES PATENT AND TRADEMARK OFFICE

CERTIFICATE OF CORRECTION

PATENT NO. : 7,165,599 B2
APPLICATION NO. : 10/769092
DATED : January 23, 2007
INVENTOR(S) : Kiyoto Takizawa et al.

It is certified that error appears in the above-identified patent and that said Letters Patent is hereby corrected as shown below:

Column 8, claim 1, line 11, “than inner” should read --than an inner--.

Signed and Sealed this

Eleventh Day of December, 2007

JON W. DUDAS
*Director of the United States Patent and Trademark Office*